US009295118B2

(12) United States Patent
Nietfeld

(10) Patent No.: US 9,295,118 B2
(45) Date of Patent: Mar. 22, 2016

(54) METHOD FOR OPERATING A CIRCUIT CONFIGURATION WITH A CONTROL AND/OR REGULATING MEANS FOR A LIGHT DIODE FIELD

(71) Applicant: Hella KGaA Hueck & Co., Lippstadt (DE)

(72) Inventor: Dieter Nietfeld, Paderborn (DE)

(73) Assignee: HELLA KGAA HUECK & CO. (DE)

( * ) Notice: Subject to any disclaimer, the term of this patent is extended or adjusted under 35 U.S.C. 154(b) by 47 days.

(21) Appl. No.: 14/379,466

(22) PCT Filed: Jan. 28, 2013

(86) PCT No.: PCT/EP2013/051534

§ 371 (c)(1),
(2) Date: Aug. 18, 2014

(87) PCT Pub. No.: WO2013/124120

PCT Pub. Date: Aug. 29, 2013

(65) Prior Publication Data

US 2015/0022112 A1 Jan. 22, 2015

(30) Foreign Application Priority Data

Feb. 21, 2012 (DE) ..... 10 2012 101 363

(51) Int. Cl.
*H05B 37/02* (2006.01)
*H05B 39/04* (2006.01)
(Continued)

(52) U.S. Cl.
CPC ..... *H05B 33/0815* (2013.01); *H05B 33/083* (2013.01); *H05B 33/089* (2013.01); *H05B 33/0827* (2013.01)

(58) Field of Classification Search
None
See application file for complete search history.

(56) References Cited

U.S. PATENT DOCUMENTS 7,928,856 B2 * 4/2011 Jacubovski et al. ..... 340/653
8,169,150 B2 * 5/2012 Peker et al. ..... 315/246

(Continued)

FOREIGN PATENT DOCUMENTS

DE 102005012625 A1 9/2006
DE 60209677 T2 11/2006

(Continued)

*Primary Examiner* — Anh Tran
(74) *Attorney, Agent, or Firm* — Husch Blackwell LLP

(57) ABSTRACT

A method for operating a circuit configuration which includes a power source, a light diode field switched serially with the power source in which the light diode field comprises at least two serial circuits including at least one light diode and a switch, a control and/or regulating means for the light diode field, and a voltage sensor. The control and/or regulation means controlling the controllable switches and the power source such that the control and/or regulation means addresses the controllable switch of at least one serial circuit of the light diode field during a clock cycle for a pulse duration determined by the control and/or regulation means using a control pulse at the control input of the controllable switch for closing. The control and/or regulation means addresses the power source shortly before or at the latest simultaneous with the end of a pulse duration such that the current is reduced, namely by the amount of current through the serial circuit. The controllable switch at the end of the pulse duration is addressed by the control and/or regulation means for opening. During subsequent clock cycles the control and/or regulation means switch on only one of the controllable switches of the serial circuits for a period identified as diagnostics period.

11 Claims, 4 Drawing Sheets

(51) Int. Cl.
*H05B 41/36* (2006.01)
*H05B 33/08* (2006.01)

(56) References Cited

U.S. PATENT DOCUMENTS

| | | | | |
|---|---|---|---|---|
| 2007/0195025 | A1 | 8/2007 | Korcharz et al. | |
| 2011/0227503 | A1* | 9/2011 | Yuan et al. | 315/294 |

FOREIGN PATENT DOCUMENTS

| | | | |
|---|---|---|---|
| DE | 102010060857 | A1 | 5/2012 |
| EP | 1839928 | A2 | 10/2007 |
| EP | 2197243 | A1 | 6/2010 |
| WO | 2008007106 | A1 | 1/2008 |
| WO | 2010030462 | A1 | 3/2010 |

* cited by examiner

METHOD FOR OPERATING A CIRCUIT CONFIGURATION WITH A CONTROL AND/OR REGULATING MEANS FOR A LIGHT DIODE FIELD

CROSS REFERENCE

This application claims priority to PCT application number PCT/EP2013/051534, filed Jan. 28, 2013, which itself claims priority to German Application No. 10 2012 101363.2, filed Feb. 21, 2012, both of which are hereby incorporated by reference.

FIELD OF THE TECHNOLOGY

The invention concerns a method for operating a circuit configuration with a power source, a light diode field switched serially with the power source in which the light diode field comprises at least two serial circuits including at least one light diode and a controllable switch, a control and/or regulating means, and a voltage sensor. The control and/or regulation means controls the controllable switches and the power source, such that the control and/or regulation means addresses the controllable switch of at least one serial circuit of the light diode field during a clock cycle for a pulse duration determined by the control and/or regulation means using a control pulse at the control input of the controllable switch for closing. The control and/or regulation means addresses the power source shortly before or at the latest simultaneous with the end of the pulse duration such that the current is reduced, namely by the amount of current through the serial circuit, with its controllable switch at the end of the pulse duration being addressed by the control and/or regulation means for opening.

BACKGROUND

Such a method is disclosed in the German patent publication with the official reference DE 10 2010 060 857.2. The application further discloses a circuit configuration and a control and/or regulation means by which the method can be implemented. The pulse durations, during which the controllable switches of the serial circuits are addressed for closing, are selected in the disclosed method such that the light diodes of the parallel switched serial circuits show the same mean brightness. Controllable switches switched serially with light diodes showing a low flux voltage consequently are switched on for a shorter period of time than the controllable switches switched serially with the light diodes showing a high flux voltage.

In the German patent application it is not disclosed what processes occur when one of the light diodes fails. A failure of one light diode could for example be caused by short-circuitry of the light diode or by an interruption of the current path via the light diode.

SUMMARY OF THE INVENTION

In the present invention a solution is offered for these two possible scenarios of failure by which initially the failure is detected and (describes) the process how to proceed upon the detection of the failure, in order to circumvent the failure.

The invention is based on the problem to improve a method of the type mentioned at the outset such that the detection of failure is possible.

This problem is attained according to the invention such that during successive clock cycles the control and/or regulation means switches on only one of (at least one of) the controllable switches for a period identified as the diagnostics period. Thus, during this diagnostics period current can flow to the light diode only via the closed serially arranged controllable switch. According to the electric characteristics of the light diode and the controllable switch then a voltage develops over the electrified serial circuit. This voltage can be detected and represents the foundation for detecting a failure.

According to the invention, in a number of n serial circuits each controllable switch can be switched on for the diagnostics period in n successive clock cycles. Here it is ensured that at least after n clock cycles the failure of the light diode has been detected. However, it is also possible to select a different rhythm for addressing the controllable switches for closing. In particular it is also possible that the controllable switch to be closed during the diagnostics period is selected at random.

The diagnostics period, during which a controllable switch is addressed for closing may be a part of a pulse duration during which the same switch is addressed in all clock cycles for closing. Then the overall duration of activation of the controllable switch during the clock cycle changes just as little as the mean brightness of the light diodes (switched) serially with the controllable switch. The pulse durations at which the other controllable switches remain closed during the same clock cycles also remain unaffected by the diagnostics period. Due to the diagnostics period, if applicable, the start or the end of the pulse durations must be shifted for switching on the other controllable switches from one clock cycle to the next.

When the pulse durations, during which the controllable switches are switched on within a clock cycle, can be shifted in reference to each other such that several or all controllable switches during a diagnostics period within a clock cycle are switched on alone, it is possible to check several or all light diodes of the light diode field with regards to one of the failures described. For this purpose perhaps a pulse duration must be divided so that one of the controllable switches is switched on for two periods during a clock cycle, with these periods together forming the pulse duration.

The diagnostics period may be at the beginning of the pulse duration, and after the end of the diagnostics period other controllable switches can be addressed for closing as well.

According to the invention the diagnostics period may be at the beginning of the clock periods.

The diagnostics period may amount to 50 μs. However, longer or shorter diagnostics periods are also possible. The diagnostics period may be of identical or different length from one clock cycle to the next.

The circuit configuration may show a voltage sensor by which during the diagnostics period the voltage over the light diode field is detected. The voltage over the light diode field develops depending on the characteristics of the light diodes and the closed controllable switch, thus from the voltage measured here conclusions can be drawn for the functionality of the light diode.

The voltage over the light diode field detected during the diagnostics period can be compared by the control and/or regulation means to a predetermined value. When a predetermined value plus a predetermined tolerance is exceeded by the voltage detected, the controllable switch, which was closed for the detection during the diagnostics period, can be switched off lastingly, i.e. also for subsequent clock cycles. The light diode, which failed probably due to an interruption of a current path through the serial circuit, is then shut off lastingly.

In the event the voltage detected falls short of the predetermined value minus a tolerance, the controllable switch, which was closed for the detection during the diagnostics period, can be shut-off lastingly. In case of a low voltage and/or comparatively insufficient voltage over the light diode field and/or the only switched-on serial circuit, a short circuit of the light diode can be concluded, thus the lasting shut-off is reasonable.

After a lasting shut-off via the control and/or regulation means the pulse durations, during which the remaining controllable switches are closed, can be extended and/or the current of the shut-off serial circuit can be distributed over the remaining serial circuits. This way, although the mean brightness of the still operating light diodes is increased, the mean brightness of the overall circuitry can be upheld under certain circumstances, in spite of the lastingly shut-off light diode or light diodes. Here it must be observed though that the thermal and electric capacity of the light diodes or controllable switches, which are not lastingly shut-off, are not exceeded.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
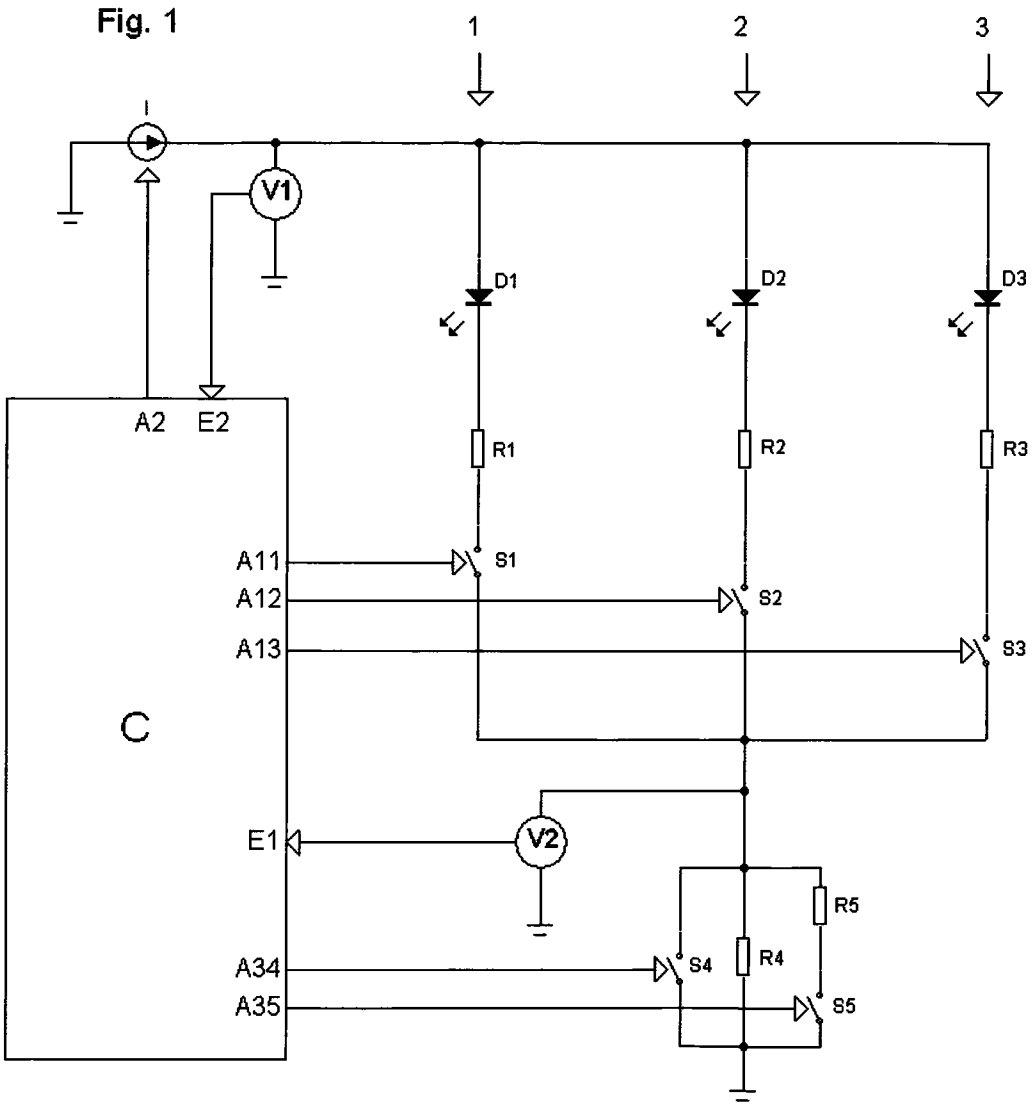
FIG. 1 is a block diagram of the circuit configuration, by which the method according to the invention can be implemented.

The circuit configuration illustrated in FIG. 1 shows a light diode field comprising three serial circuits D1, R1, S1, D2, R2, S2, D3, R3, S3. Each serial circuit 1, 2, 3 comprises a light diode D1, D2, D3, a resistor R1, R2, R3, and a switch S1, S2, S3. According to the indices of the identification of the components, in the following the first serial circuit 1, the second serial circuit 2, and the third serial circuit 3 are discussed.

The serial circuits 1, 2, 3 are switched parallel. The light diodes D1, D2, D3 are arranged within the serial circuits such that their anodes are connected to a joint hub. The controllable switches S1, S2, S3 show a joint hub as well. The resistors R1, R2, R3 are arranged between the diodes D1, D2, D3 and the controllable switches S1, S2, S3.

In addition to the light diode field, the circuit configuration also shows a power source I, which is switched upstream in reference to the hub at the side of the anode. The power source I is a controllable power source.

A parallel circuit with measuring resistors is arranged downstream in reference to the hub at the side of the switch. A controllable switch S4 is arranged in the first path of the parallel circuit. The controllable switch advantageously represents a transistor, with its emitter collector path forming a first measuring resistor and thus the measuring resistor of the first path of the parallel circuit. A measuring resistor R4 is arranged in a second path. A serial circuit comprising a measuring resistor R5 and a controllable switch S5 are arranged in a third path. The parallel circuit is connected via ground to the power source I.

A voltage sensor V1 and a current sensor V2 are provided in the circuit configuration. The voltage sensor V1 detects the voltage between the hub at the anode side and the ground potential. The current sensor V2 detects the current flowing through the light diode field via the detour of measuring the voltage applied over the parallel circuit of the measuring resistors.

Furthermore, according to the circuit arrangement a control and/or regulation means C is provided according to the invention. The control and/or regulation means C shows several inputs and several outputs. The control and/or regulations means C is connected via these inputs and outputs to the controllable power source I, the controllable switches S1, S2, S3 of the light diode field, the controllable switches S4, S5, the parallel circuit of the measuring resistors, the voltage sensor V1, and the current sensor V2.

In detail, the connections between the structural elements and/or components and the inputs and outputs, respectively, of the control and/or regulation means is generated as follows:

A first input of the control and/or regulation means C is connected to the current sensor V2. The current and/or an equivalent voltage, detected by the current sensor V2, can be supplied via the first input E1 to the control and/or regulation means C.

A second input E2 of the control and/or regulation means is connected to the voltage sensor V1. A signal indicating the voltage between the hub at the anode side and the ground potential can be fed via this input E2 to the control and/or regulation means.

First outputs A11, A12, A13 of the control and/or regulation means are connected to control connections of the controllable switches S1, S2, S3 of the serial circuits 1, 2, 3 of the light diode field.

Control pulses can be transmitted via these first outputs A11, A12, A13 to the switches in order to close them.

A second output A2 is connected to the controllable power source I. A signal can be transmitted via this second output A2 from the control and/or regulation means to the controllable power source I in order to adjust the current supplied by the power supply I.

The control and/or regulation means, which may represent a microcontroller or an ASIC, is implemented such that the light diodes D1, D2, D3 show the desired brightness. For this purpose, due to tolerances of parameters of the light diodes, particularly different flux voltages of the light diodes and different currents in the serial circuits 1, 2, 3 are necessary. The power source is adjusted by the control and/or regulation means C such that it provides a current, which is sufficient to supply the serial circuit with power, which comprises the light diode with the highest flux voltage. This is for example a light diode D3 in the third serial circuit 3. The first serial circuit 1 shall, however, show the light diode D1 with the lowest flux voltage and the second serial circuit 2 a light diode D2 with a medium flux voltage.

The current supplied by the controllable power source I splits at the hub at the anode side into the respective currents which flow through the serial circuits 1, 2, 3. The splitting of the current depends here on the components of the serial circuits 1, 2, 3. These elements also include the light diodes D1, D2, D3 with their different flux voltages. The currents are split such that the serial circuit with the light diode showing the lowest flux voltage, thus the first serial circuit, carries the highest current, while the serial circuit with the light diode D3 showing the highest flux voltage, namely the serial circuit 3, carries the lowest current.

In order for the third light diode D3 with the highest flux voltage to provide the desired brightness, here the current of the controllable power supply I must be adjusted such that the current required for the desired brightness to be provided flows through the third serial circuit 3 and thus through the third light diode D3.

This, however, leads to currents in the other serial circuits 1, 2, which are higher than the currents necessary to generate the desired brightness by the light diodes D1 and D2. The light diodes D1 and D2 and the serial circuits 1 and 2, respectively, are therefore switched on and off. This leads to a current through the first and the second serial circuit 1, 2, which on average is equivalent to the current necessary for generating the desired brightness.

The switching on and off occurs with such a high frequency that it is not visible for the human eye.

Figure 2:
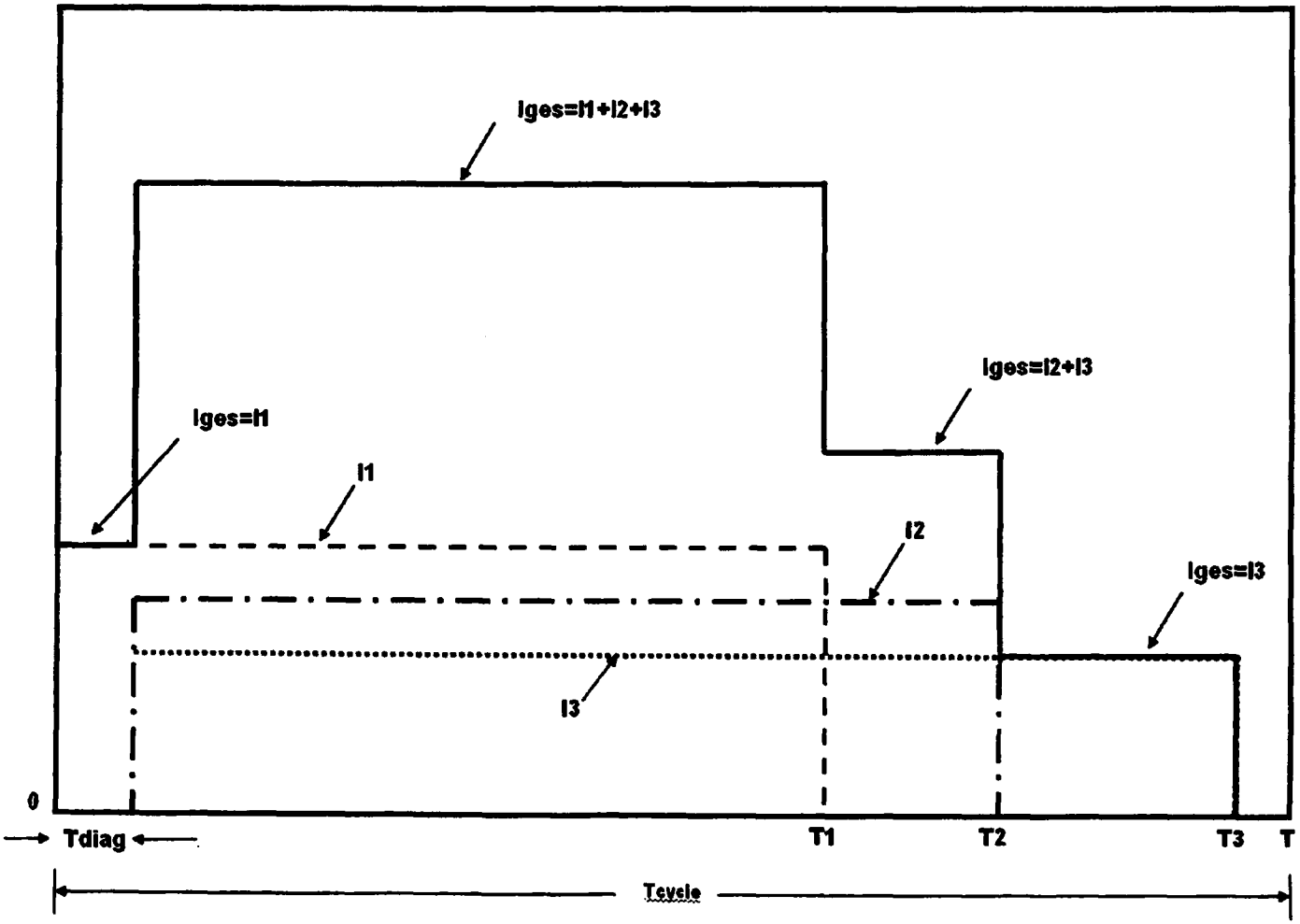
FIG. 2 is a progression of currents in the circuit configuration according to the invention during a first clock cycle.
Figure 3:
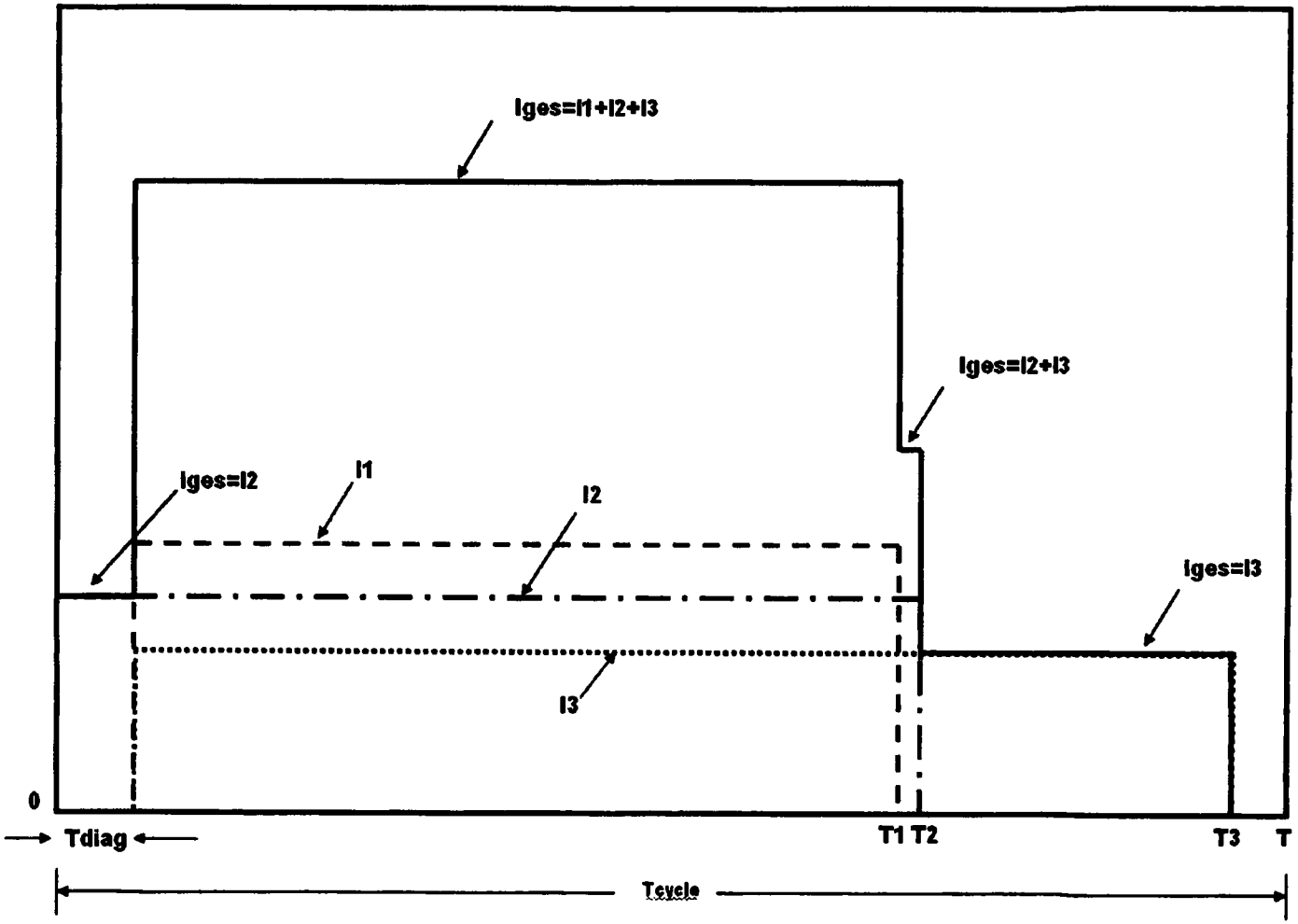
FIG. 3 is a progression of currents in the circuit configuration according to the invention during a second clock cycle.
Figure 4:
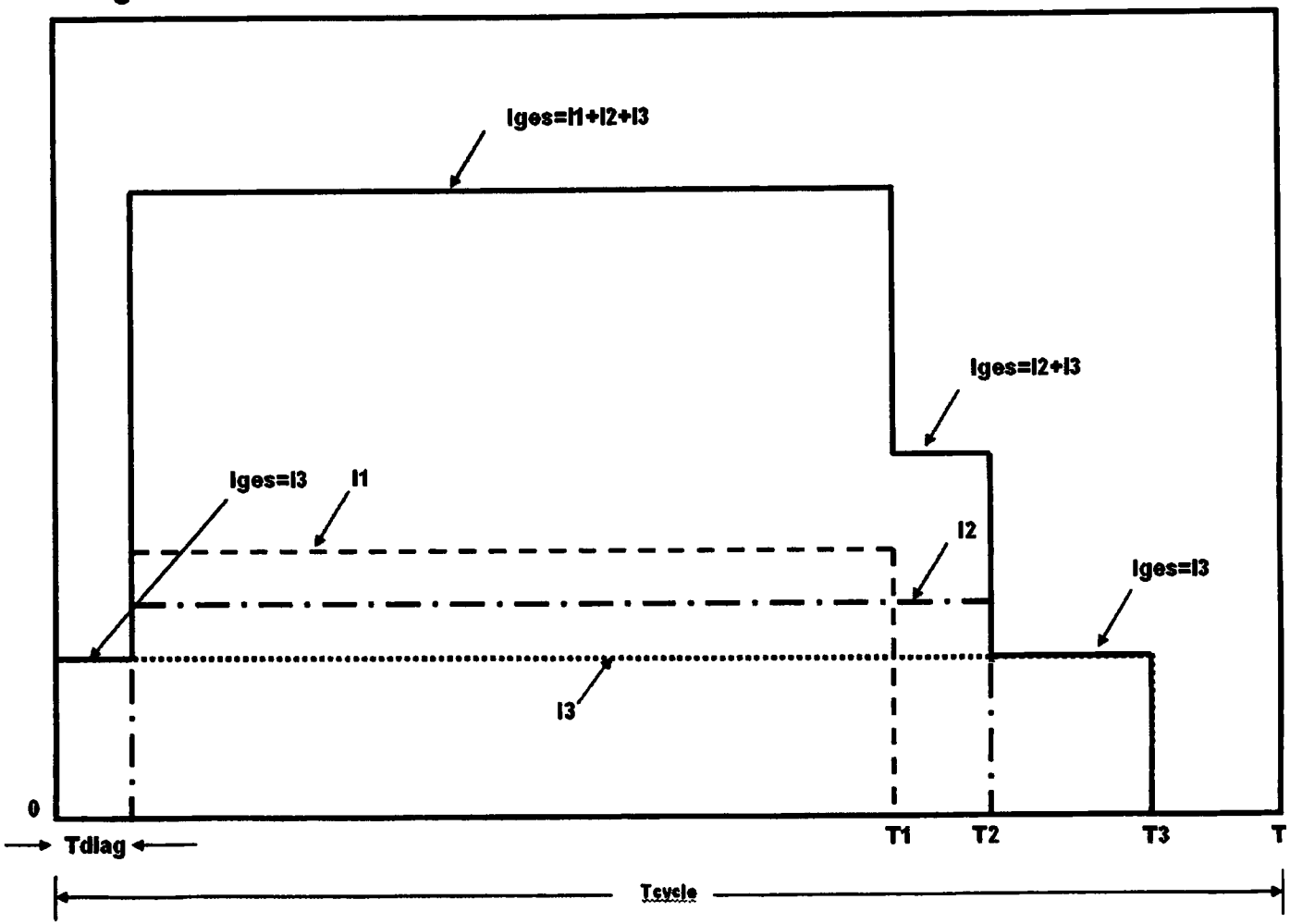
FIG. 4 is a progression of currents in the circuit configuration according to the invention during a third clock cycle.

The example of FIGS. 2, 3, and 4 shows three successive clock cycles Tcycle. Within the clock cycles the controllable switch S3 in the third serial circuit 3 is switched on for a pulse duration T3. Similarly the controllable switches S1, S2 of the first and the second serial circuit 1, 2 are switched on for pulse durations T1, T2, with the pulse duration T2 being shorter than the pulse duration T3 and the pulse duration T1 shorter than the pulse duration T2. The pulse durations T1, T2, T3 are selected such that on average of the clock cycles T current flows through the serial circuit 1, 2, 3, which on average yields the desired brightness of the light diodes. The controllable power source I is here controlled such that at the end of the respective pulse durations T1, T2, T3 the power supply Iges of the controllable power source I is reduced by the power accepted by the serial circuit switched off at the end of the pulse duration T1, T2, T3. This way the controllable power source I provides precisely the current Iges which is necessary to supply the switched-on serial circuits.

A period is provided at the beginning of the clock cycles Tcycle which is called the diagnostics period Tdiag. During this period only one of the controllable switches is addressed for closing so that during this period only one serial circuit is flowed through by a current.

According to the electric characteristics of the serial circuit 1, 2, 3 flowed-through by current, during the diagnostics period Tdiag a voltage develops over the light diode field, which is detected by the voltage sensor V1. If the detected voltage is within the predetermined tolerance range, it can be assumed that the light diode operates as desired. However, if a deviation of the detected voltage is determined, thus the voltage is not within the tolerance range, the controllable switch, which was switched on during the diagnostics period Tdiag during which the deviation was detected, is switched of lastingly.

During the clock cycles Tcycle all pulse durations T1, T2, T3 are always of identical length so that the same mean brightness is always provided by the light diodes D1, D2, D3. The diagnostics periods Tdiag are therefore a part of the pulse durations. In order to achieve that during the diagnostics periods, in spite of the same pulse durations T1, T2, T3, always only one controllable switch element is switched on, in the exemplary embodiment shown the points of time at the beginning and the point of time at the end of the pulse durations T1, T2, T3 are shifted in reference to the diagnostics period Tdiag when the switches are not switched on during the diagnostics period Tdiag.

LIST OF REFERENCE CHARACTERS

I controllable power source
V1 voltage sensor
V2 current sensor
D1 light diode of the first serial circuit
R1 resistor of the first serial circuit
S1 controllable switch of the first serial circuit
D2 light diode of the second serial circuit
R2 resistor of the second serial circuit
S2 controllable switch of the second serial circuit
D3 light diode of the third serial circuit
R3 resistor of the third serial circuit
S3 controllable switch of the third serial circuit
C control and/or regulation means
S4 controllable switch in the first path of the parallel circuit of measuring resistors
R4 resistor in the second path of the parallel circuit of measuring resistors
S5 controllable switch in the third path of the parallel circuit of measuring resistors
R5 resistor in the third path of the parallel circuit of measuring resistors Tcycle clock cycle
T1 pulse duration
T2 pulse duration
T3 pulse duration
I1 current through the serial circuit 1
I2 current through the serial circuit 2
I3 current through the serial circuit 3
Iges total current through the light diode field
Tdiag diagnostics period

The invention claimed is:

1. A method for operating a circuit configuration which includes a power source, a light diode field switched serially with the power source in which the light diode field comprises at least two serial circuits which include at least one light diode and a controllable switch, a control regulation means for the light diode field, and a voltage sensor, the method comprising the steps of:

controlling the controllable switches and the power source with the control regulating means, wherein the control regulation means addresses the controllable switch of at least one serial circuit of the light diode field during a clock cycle for a pulse duration determined by the control regulation means using a control pulse at the control input of the controllable switch for closing, and wherein the control regulation means address the power source shortly before or at the latest simultaneous with the end of the pulse duration such that the power is reduced, namely by the amount of current through the serial circuit, with its controllable switch at the end of the pulse duration being addressed by the control regulation means for opening, and wherein during subsequent clock cycles the control regulation means address exclusively one of the controllable switches of the serial circuits for a period identified as diagnostics period for closing.

2. The method according to claim 1, wherein at a number of n serial circuits in n successive clock cycles each controllable switch is addressed for the diagnostics period for closing.

3. The method according to claim 1, wherein the diagnostics period, during which a controllable switch is addressed for closing, represents a portion of the pulse duration, during which the same switch is addressed in all clock cycles for closing.

4. The method according to claim 1, wherein the diagnostics period is given at the beginning of the pulse duration and upon expiration of the diagnostics period other controllable switches can also be addressed for the purpose of closing.

5. The method according to claim 1, wherein the diagnostics period is given at the beginning of a clock cycle.

6. The method according to claim 1, wherein the diagnostics period measures 50 μs.

7. The method according to claim 1, wherein the circuit configuration comprises a voltage sensor by which during the diagnostics period the voltage at the light diode field is detected.

8. The method according to claim 7, wherein the voltage at the light diode field detected during the diagnostics period is compared by the control regulation means with a predetermined value.

9. The method according to claim 8, wherein upon the detected voltage exceeding the predetermined value plus a predetermined tolerance the controllable switch, which was closed at the detection during the diagnostics period, is lastingly shut off, i.e. for the subsequent clock cycles as well.

10. The method according to claim 8, wherein in case the detected voltage falls short of the predetermined value minus a tolerance the controllable switch, which was closed at the detection during the diagnostics period, is lastingly shut off.

11. The method according to claim 9, wherein after a lasting shut-off by the control regulation means the pulse durations, during which the remaining controllable switches are closed, are extended.

* * * * *